US007553177B2

(12) United States Patent
Antonini et al.

(10) Patent No.: US 7,553,177 B2
(45) Date of Patent: Jun. 30, 2009

(54) HIGH DENSITY BAYONET MATING CONNECTOR

(75) Inventors: Gino S. Antonini, New Fairfield, CT (US); Matthew M. Polito, Parrish, FL (US); Owen R. Barthelmes, Putnam Valley, NY (US); Michael A. Hoyack, Sandy Hook, CT (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 11/856,609

(22) Filed: Sep. 17, 2007

(65) Prior Publication Data

US 2008/0113536 A1 May 15, 2008

Related U.S. Application Data

(60) Provisional application No. 60/825,875, filed on Sep. 15, 2006.

(51) Int. Cl.
*H01R 13/213* (2006.01)

(52) U.S. Cl. ..... 439/314; 439/491; 439/315

(58) Field of Classification Search ..... 439/314–321, 439/488–491

See application file for complete search history.

(56) References Cited

U.S. PATENT DOCUMENTS

| | | | |
|---|---|---|---|
| 4,289,368 | A | 9/1981 | Schildkraut |
| 6,811,423 | B2 | 11/2004 | Yoshigi |
| 6,921,283 | B2 | 7/2005 | Zahlit et al. |
| 7,181,999 | B1 | 2/2007 | Skeels et al. |
| 2004/0198095 | A1 | 10/2004 | Laverick |

*Primary Examiner*—Khiem Nguyen
(74) *Attorney, Agent, or Firm*—Blank Rome LLP

(57) ABSTRACT

An electrical connector may include a body and a sleeve rotatably attached to body. The sleeve may include at least one slot adapted to engage at least one other connector, and at least one indicator groove adapted to align with the at least one other connector.

11 Claims, 4 Drawing Sheets

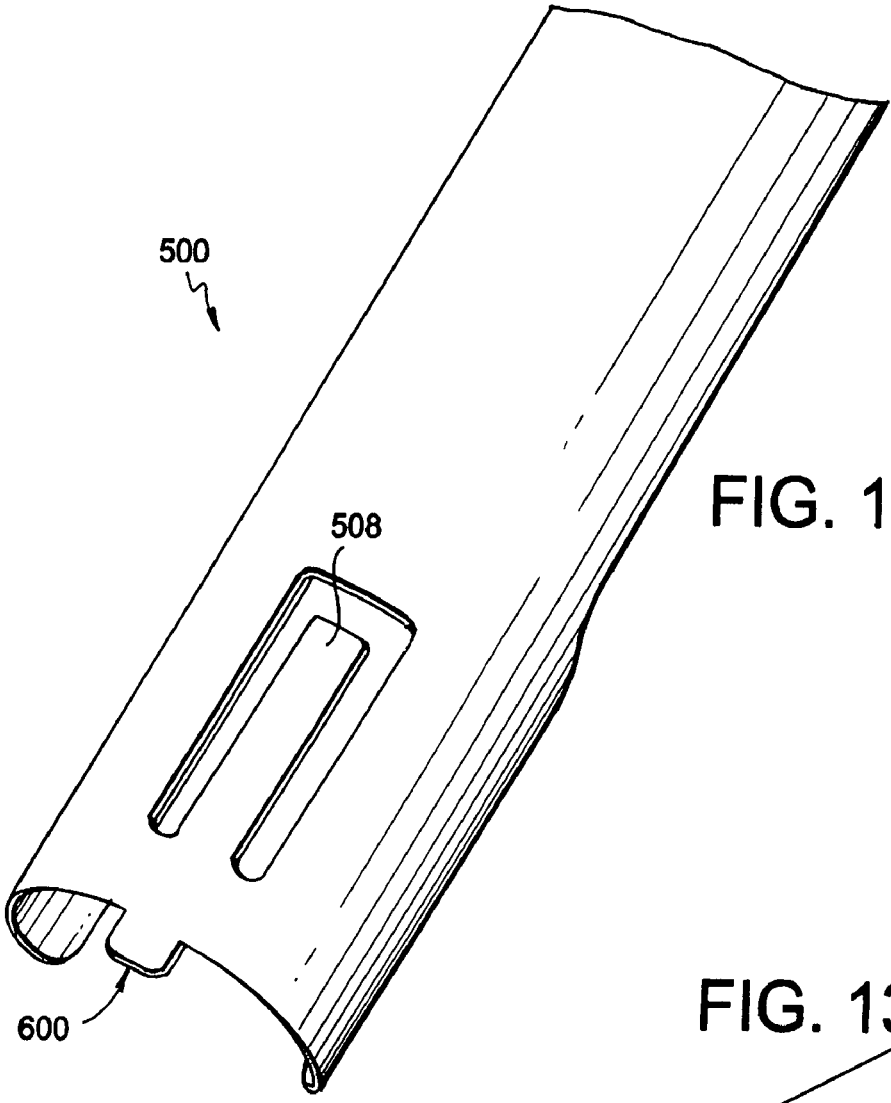
FIG. 12
FIG. 13
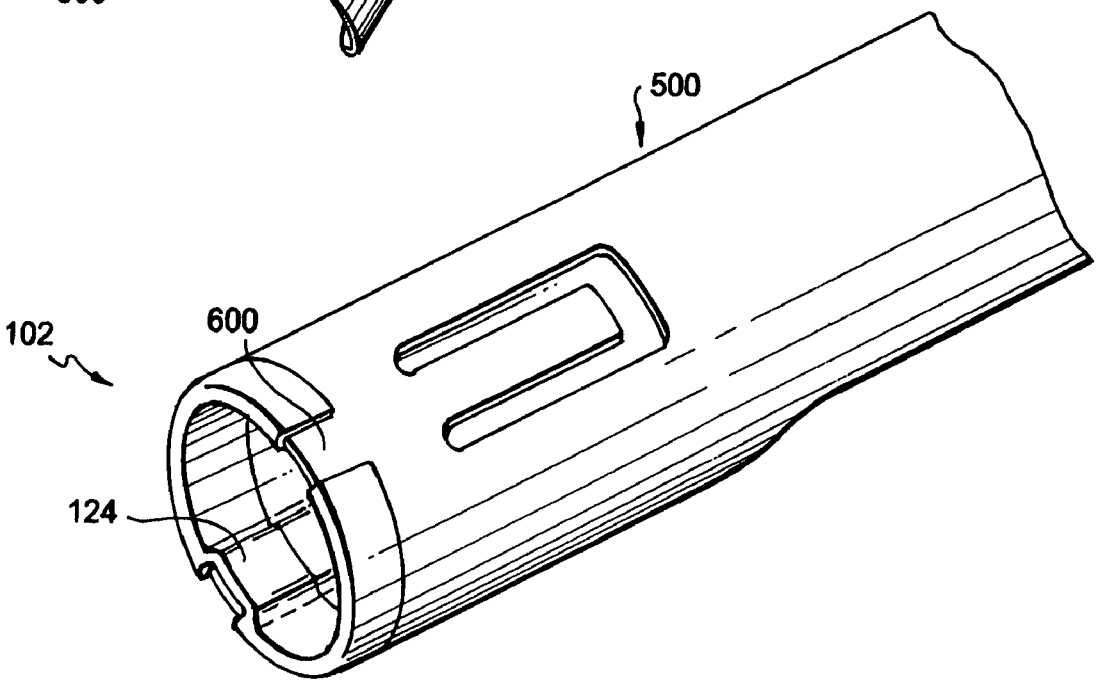

HIGH DENSITY BAYONET MATING CONNECTOR

CLAIM TO PRIORITY

This application claims priority to U.S. Provisional Patent Application Ser. No. 60/825,875, filed Sep. 15, 2006, the entire contents of which are incorporated by reference herein.

FIELD OF THE INVENTION

The present invention relates generally to the field of electrical connectors. In particular, the present in invention relates to a mechanism for providing a visual indication of the coupling of connectors in high-density applications.

BACKGROUND OF THE INVENTION

Electrical connectors, particularly radio frequency (RF) connectors, provide couplings between electrical elements and/or devices. Many different types of electrical connectors exist and have been used to provide removable electrical connections between electronic elements and devices.

Conventional BNC coupling connector pairs facilitate attachment of coaxial electrical cables to electronic elements or devices. Typical BNC coupling connector pairs include a jack-side connector mounted to an electronic device or element and a plug-side connector connected to a cable. The jack-side connector typically includes a tubular cylindrical housing and a socket formed in a central location of the housing. The plug-side connector typically includes a tubular cylindrical connector body having a central contact formed in a central location of the connector body. The central contact of the plug-side connector is inserted into the socket of the jack-side connector and the connector body of the plug-side connector is inserted into the housing of the jack-side connector.

BNC connector pairs allow a reliable electrical connection to be made without the danger of the jack-side and plug-side connectors gradually becoming loose or becoming inadvertently unplugged. The bayonet mechanism of BNC coupling of connector pairs provides a positive engagement between jack-side connectors and plug-side connectors. This positive engagement allows a user to determine whether a jack-side connector is fully engaged with a plug-side connector by rotating the bayonet sleeve by manual manipulation. If substantial resistance is encountered during rotation, then the coupling connector pair is fully engaged.

Often, multiple coupling connector pairs are positioned in close proximity to one another on electronic elements or devices, both vertically and horizontally, so that there is insufficient space for manual manipulation of the connector. Also, it is often not possible for a user to inspect visually for full engagement of coupling connector pairs. No viewpoint allows a visual inspection of one connector relative to the other connector. Therefore, a need exists for an improved coupling connector pair that provides a visual indication of full engagement of the plug-side connector with the jack-side connector.

SUMMARY OF THE INVENTION

Accordingly, a non-limiting aspect of the present invention provides a connector configured to engage another connector to form an electrical connection, including a connector body and a sleeve rotatably connected to said connector body. The sleeve may have at least one slot therein configured for engagement with a corresponding portion on the other connector. Each of the slots may have an entry portion and a terminal portion. The at least one indicator groove may align with the terminal portion of the slot and the indicator groove may be configured to align with the portion of the other connector when the lug is received in the terminal portion of the slot.

Another non-limiting aspect of the present invention provides an installation and removal tool, which includes a shaft and a handle allowing application of torque to the rigid shaft. The handle is disposed at one end of said rigid shaft. The clasp may be configured to slide over a connector. The clasp may be fixed to one end of the shaft opposite the handle. At least one keyed alignment member may be disposed in the clasp and sized to engage into at least one indicator groove disposed on the exterior surface of said connector.

Yet another non-limiting aspect of the present invention provides a connector and tool assembly that includes a connector with at least one indicator groove thereon. An installation and removal tool may have at least one keyed alignment member that detachably engages the at least one groove of connector. The connector and tool coupling may further include a keyed alignment member that may be a tab extending radially inward from a portion of said clasp.

Still another non-limiting aspect of the present invention provides a method of detachably coupling a connector and an installation and removal tool, the method including: aligning a keyed alignment member disposed on a clasp of the installation/removal tool with an indicator groove on the connector, and positioning the installation and removal tool so that the keyed alignment member detachably engages the groove on the connector. The method may further include forming the keyed alignment member as a tab by deforming radially inward a portion of said clasp.

Another non-limiting aspect of the present invention provides a method of connecting first and second connectors using an installation and removal tool. The method may include: aligning a keyed alignment member disposed on the clasp of the installation and removal tool with a groove on an outer surface of a first connector; sliding the installation and removal tool longitudinally over the first connector so that the keyed alignment member engages and slides longitudinally in the groove on the outer surface of the first connector; bringing together the first connector with a second connector by using said installation and removal tool; aligning a plurality of slots of the first connector with a plurality of lugs on the second connector using the installation and removal tool; inserting lugs into an entry portion of each slot; and rotating the installation and removal tool so that the lugs are positioned in the terminal portion of the slots and the plurality of slots on the first connector engages the corresponding plurality of lugs on the second connector.

Another exemplary aspect of the invention may include removing the installation and removal tool by sliding the installation and removal tool longitudinally away from the first connector. The method can also include the step of forming the keyed alignment member as a tab by deforming radially inward a portion of said clasp.

Other objects, advantages and salient features of the invention will become apparent from the following detailed description, which, taken in conjunction with the annexed drawings, discloses non-limiting embodiments of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 12 is a perspective view of an alignment tab of the installation/removal tool; and FIG. 13 is a perspective view of the connector and tool coupling showing the alignment tab received in the groove of the plug-side connector.

DETAILED DESCRIPTION OF THE EMBODIMENTS

Figure 1:
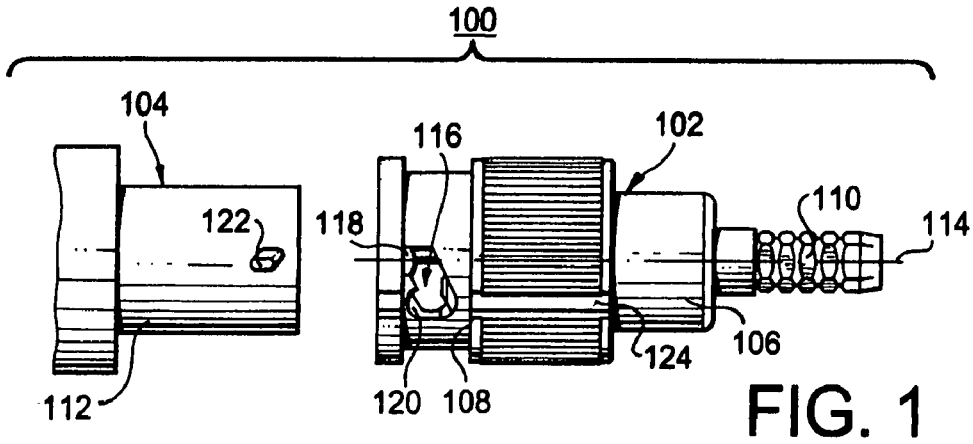
FIG. 1 is a top view of a coupling connector pair of the present invention, including a jack-side connector and a plug-side connector.

Referring to FIG. 1, connector assembly 100 is shown. Connector assembly 100 may include a plug-side connector 102 and a jack-side connector 104. Plug-side connector 102 is configured for engagement with jack-side connector 104 to form an electrical connection. Plug-side connector 102 may be similar to a conventional BNC connector, except it includes a visual indicator to facilitate mating of the plug-side connector 102 and jack-side connector 104.

The plug-side connector 102 includes a plug-side connector body 106, a bayonet sleeve 108, and a ferrule 110. Plug-side connector body 106 is configured for mating with a jack-side connector body 112 of jack-side connector 104 along a longitudinal axis 114. Bayonet sleeve 108 is rotatably mounted on plug-side connector body 106, and includes at least one slot 116, which may be j-shaped as shown in FIG. 1. The J-shaped slot 116 includes an entry portion 118 and a terminal portion 120. Slot 116 is configured and arranged for engagement with a lug 122 of jack-side connector body 112. Bayonet sleeve 108 further includes an indicator groove 124 located on bayonet sleeve 108. Indicator groove 124 aligns with the terminal portion 120 of slot 116 so that the indicator groove 124 is configured to align with a mating lug 122 of the jack-side connector 104 when the lug 122 is received in the terminal portion 120 of the slot 116, that is when lug 122 rests in the terminal portion 120 of slot 116.

As shown in FIG. 1, the jack-side connector 104 may include jack-side connector body 112 with lug 122 disposed on a peripheral surface of jack-side connector body 112. Jack-side connector 104 is inserted into plug-side connector 102 so that lug 122 is inserted into initial portion 118 of slot 116. Bayonet sleeve 108 is then rotated until plug-side connector 102 and jack-side connector 104 are fully engaged such that lug 122 rests in the terminal portion 120 of slot 116. Indicator groove 124 provides a visual indication when plug-side connector 102 is fully engaged with jack-side connector 104.

Jack-side connector 104, plug-side connector body 106, and bayonet sleeve 108 are more fully described with reference to FIGS. 3 and 4.

Figure 2:
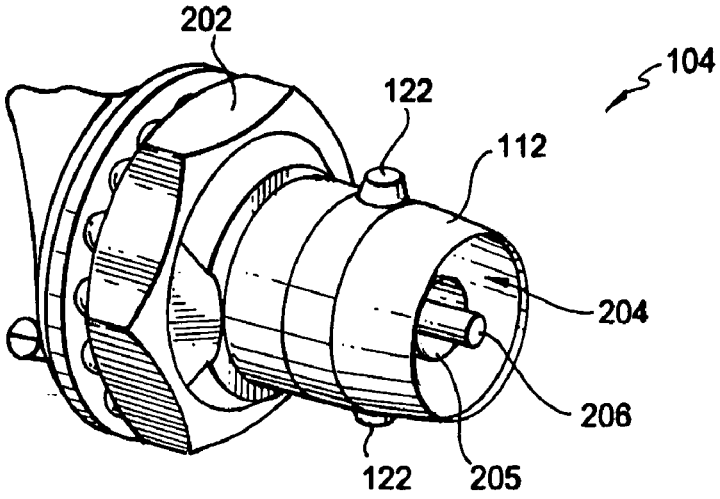
FIG. 2 is a perspective front view of a jack-side side connector.

Referring to FIG. 2, the jack-side connector 104 is shown. The jack-side connector 104 may include a jack-side connector housing 202, jack-side connector body 112, a lumen 204, a jack-side conductor 206, a jack-side connector insulator 205, and one or more lugs 122. Jack-side connector body 112 may be tubular and cylindrical and formed of a conductive material.

Lugs 122 are disposed on a peripheral surface of jack-side connector body 112. Lugs 122 are preferably cylindrical and extend radially outward from the peripheral surface of jack-side connector body 112. In an exemplary embodiment, jack-side connector 104 includes two lugs 122 positioned on jack-side connector body 112 approximately one hundred eighty degrees apart from one another. In exemplary embodiments, a jack-side connector 104 may have a single lug or three lugs. For example, the jack-side connector 104 could have three lugs 122 positioned on jack-side connector body 112 approximately one hundred twenty degrees apart. Alternatively, the jack-side connector 104 could have four lugs 122 positioned on jack-side connector body 112 approximately ninety degrees apart. In other embodiments, lugs 122 may be spaced at irregular intervals around a jack-side connector body 122.

Lumen 204 extends longitudinally through jack-side connector body 112. Jack-side connector 206 is disposed within lumen 204, and is configured to mate with a plug-side conductor 302 of plug-side connector 102 to form an electrical connection. In an exemplary embodiment, jack-side connector insulator 206 is a female socket. A jack-side connector insulator 205 may be provided within lumen 204 and around jack-side conductor 206 to electrically isolate jack-side conductor 206 from jack-side connector body 112.

Figure 3:
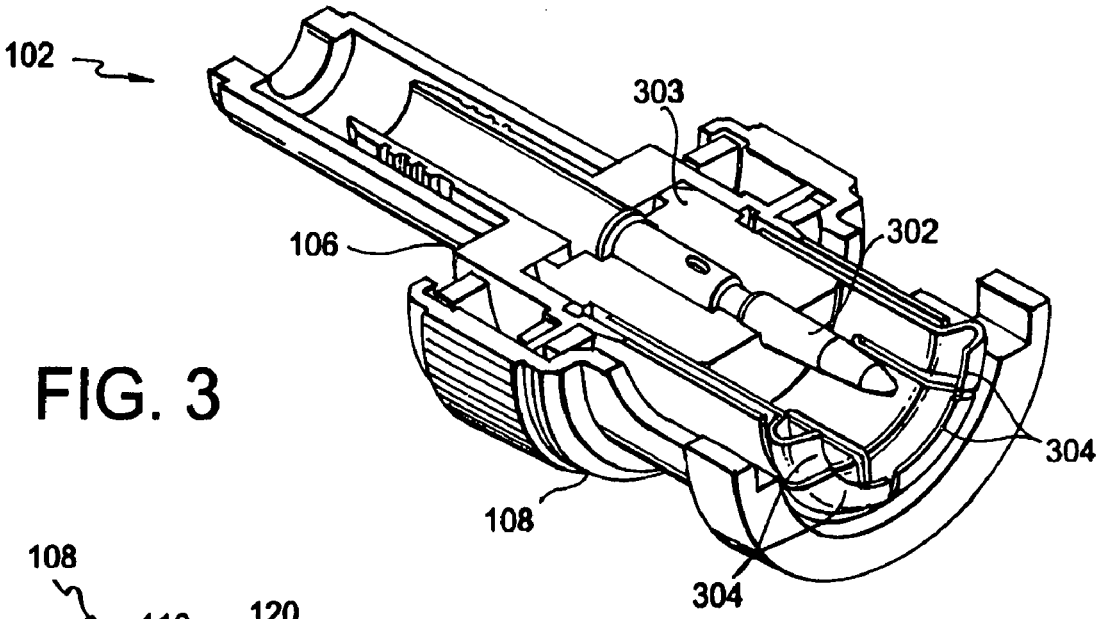
FIG. 3 is a cut-away perspective front view of a plug-side connector.

Referring to FIG. 3, a cut-away perspective front view of a plug-side connector 102, including bayonet sleeve 108 and plug-side connector body 106, is shown. Plug-side connector body 106 may be tubular and cylindrical and formed of a conductive material. Plug-side connector body 106 includes spring fingers 304, a plug-side conductor 302, and a plug-side connector insulator 303. Spring fingers 304 act to bias plug-side connector body 106 into engagement within jack-side connector body 112. Plug-side conductor 302 is configured to mate with jack-side connector body 112. Plug-side conductor 302 is configured to mate with jack-side conductor 206. In some embodiments, plug-side conductor 302 is a male contact which mates with female socket 206 of jack-side connector 104. Plug-side connector insulator 303 may be provided around plug-side conductor 302 to electrically isolate plug-side conductor 302.

In an alternate embodiment, plug-side conductor 302 and jack-side conductor 206 may be reversed so that plug-side conductor 302 is a female socket, and jack-side conductor 206 is a male contact.

In an exemplary embodiment, plug-side connector body 106 couples with jack-side connector body 112 such that spring fingers 304 fit within lumen 204 and plug-side conductor 302 couples with jack-side conductor 206 to form an electrical connection.

Figure 5:
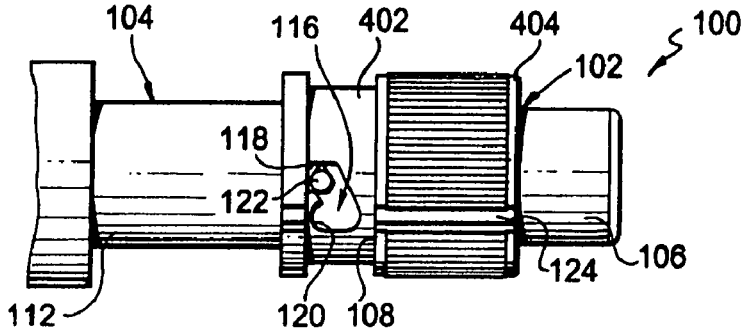
FIG. 5 is a top view of the coupling connector pair of the present invention showing the plug-side connector in partial engagement with the jack-side connector, where the lugs of the jack-side connector are positioned in the entry portion of the slots of the plug-side connector.

Referring to FIG. 5, bayonet sleeve 108 is shown. Bayonet sleeve 108 is configured to be rotatably mounted on plug-side connector body 106, and includes a recessed portion 402, slots 116, and indicator groove 124. Sleeve 108 may be tubular and cylindrical. Sleeve 108 may be formed of a conductive material.

Slots 116 are configured for engagement with lugs 122 of jack-side connector 104. In an exemplary embodiment, sleeve 108 includes two slots 116 positioned on recessed portion 402 approximately one hundred eighty degrees apart from one another, corresponding to two lugs 122 positioned approximately one hundred eighty degrees apart from one another on jack-side connector body 112. In non-limiting embodiments, a bayonet sleeve 108 having a single slot or three or more slots corresponding to a single lug or three or more lugs, respectively, could be used. In another non-limiting embodiment, sleeve 108 could include three slots positioned approximately one hundred twenty degrees apart and corresponding to three lugs 122 on jack-side connector body 112. Optionally, sleeve 108 could include four slots positioned approximately ninety degrees apart corresponding to four lugs 122 on jack-side connector body 112. In other non-limiting embodiments, slots 116 and lugs 122 may be spaced at irregular intervals around sleeve 108 and jack-side connector body 112, respectively.

Figure 4:
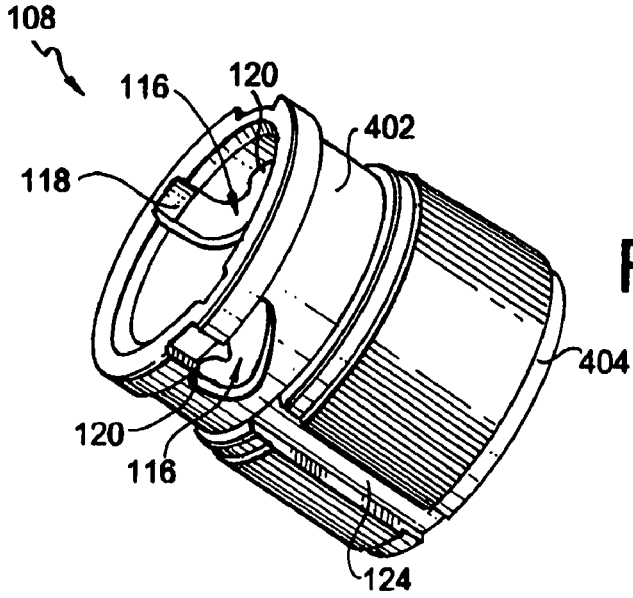
FIG. 4 is a perspective view of a bayonet sleeve of a plug-side connector.

As shown in FIG. 4, slots 116 may be substantially J-shaped. Although J-shaped slots are shown, in other non-limiting embodiments, the slots may be any type of suitable shape. J-shaped slots 116 include initial portions 118 and terminal portions 120. Slots 116 are configured to correspond and engage with lugs 122.

Bayonet sleeve 108 includes at least one indicator groove. Indicator(s) 124 are aligned with the terminal portion 120 of slot 116 and provide a visual indication that plug-side connector 102 is fully coupled with jack-side connector 104. The connectors 102 and 104 are fully coupled when lug 122 rests in the terminal portion 120 of slot 116. In an exemplary embodiment, sleeve 108 includes two indicator grooves 124 positioned on sleeve 108 approximately one hundred eighty degrees apart from each other, which correspond to two slots 116. In non-limiting embodiments with fewer or more slots 116, different corresponding numbers of indicator grooves 124 can be used at corresponding positions on sleeve 108.

In an exemplary embodiment, the indicator groove 124 is a rectangular-shaped channel longitudinally aligned with the terminal portion 120 of the slot 116. In other non-limiting embodiments, indicator groove 124 may have another shape, size, or configuration.

Figure 6:
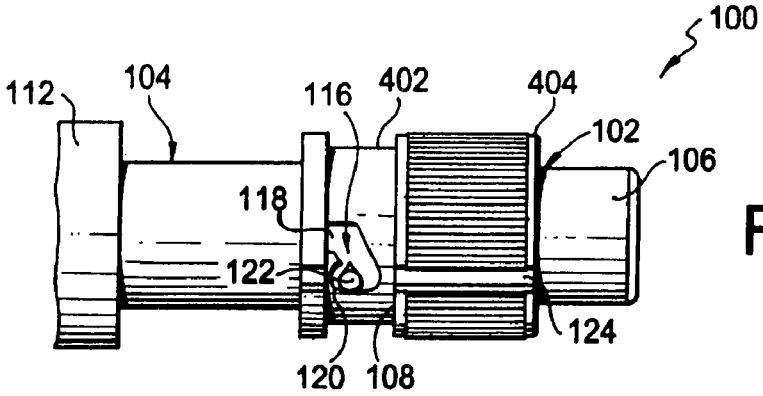
FIG. 6 is a top view of the coupling connector pair of the present invention showing the plug-side connector in full engagement with the jack-side connector, where the lugs of the jack-side connector are positioned in the terminal portion of the slots of the plug-side connector.

Referring to FIGS. 5 and 6, the mating and engagement of jack-side connector 104 and lugs 122 to plug-side connector 102 and slots 116 is shown. As shown in FIG. 5, to mate plug-side connector 102 and jack-side connector 104, lugs 122 are aligned and inserted into corresponding slots 116. When jack-side connector 104 is initially inserted into plug-side connector 102, lugs 122 are inserted into an initial portion 118 of slots 116. The slots 116 and lugs 122 are partially engaged. Next, plug-side connector 102 is pushed against jack-side connector 104 and bayonet sleeve 108 is rotated until lugs 122 are at the terminal portion 120 of slots 116. The slots 116 and lugs 122 are fully engaged at this point, because lugs 122 are now locked into position.

Indicator grooves 124 are aligned with the position where each lug 122 is locked into position in a corresponding terminal portion 120 of slot 116. In this position, the connector assembly 100 is fully engaged. The indicator groove 124 permits inspection from the back-side of plug-side connector 102 to determine whether connector assembly 100 is fully engaged.

Figure 7:
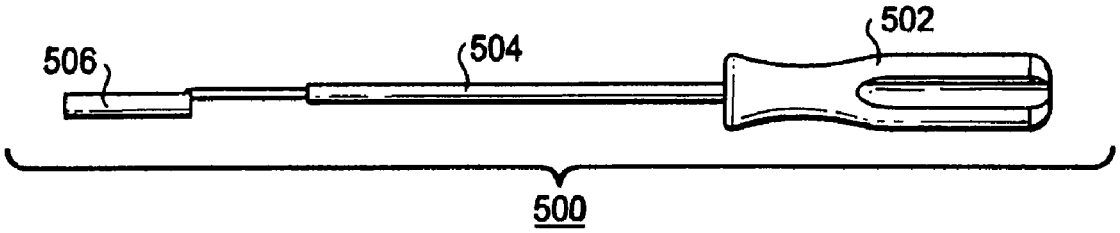
FIG. 7 is a side view of the installation/removal tool.
Figure 8:
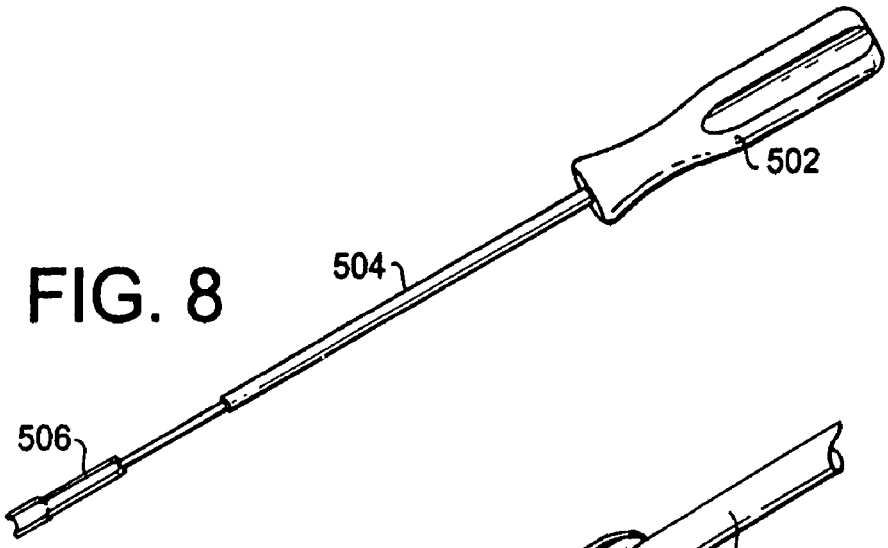
FIG. 8 is a perspective view of the installation/removal tool.

Referring to FIGS. 7 and 8, a removal and installation tool 500 is shown. The removal and installation tool may include a handle 502, a shaft 504, and a clasp 506. The handle 502 is attached to one end of the shaft 504 and the clasp 506 is attached at the opposite end of the shaft 504. The handle 504 is configured to allow an operator to manually apply torque to the removal and installation tool 500. In an exemplary embodiment, the handle 502 may be made of extruded and polished resin. However, the handle 502 may be made of any suitable material.

The handle 502 is attached to shaft 504 so as to transmit the applied torque efficiently with minimal losses in applied torque. The shaft 504 is rigid and preferably made of high strength tool steel with a corrosion-resistant clear zinc coating. The shaft 504 can be made from any material that will transmit the applied torque with minimal loss of twisting force. In an exemplary embodiment, the shaft 504 has a circular cross-section. The shaft 504 can be constructed to have any cross-section shape. At the end of the shaft 504, opposite the handle 502, is the clasp 506.

In an exemplary embodiment, the clasp 506 is configured to partially or fully encircle an exterior surface of an electrical connector. The clasp 506 could also be shaped for use with connectors that do not have a circular cross-section. Also, in an exemplary embodiment, the clasp 506 is made of the same material as the shaft 504, that is high strength tool steel with a clear corrosion-resistant zinc coating. However, the clasp may be constructed from any suitable material.

Figure 9:
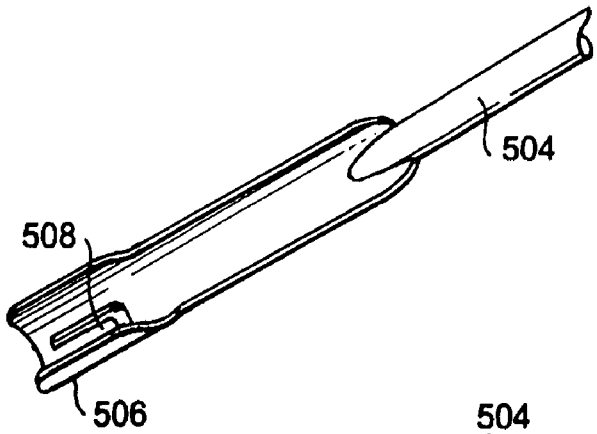
FIG. 9 is a perspective view of the clasp of the installation/removal tool.

Referring to FIG. 9, the clasp 506 may include a keyed alignment member 508. The keyed alignment member 508 is configured to travel within any indicator groove 124 on the bayonet sleeve 108. The keyed alignment member 508 can be any shape that allows it to travel in an indicator groove 124. The keyed alignment member 508 can be made of the same material as the clasp 506, but it can also be made of a material different from the clasp 506. The keyed alignment member 508 can be attached to the clasp 506, welded to clasp 506, or formed from the clasp 506 itself. In an exemplary embodiment, the keyed alignment member 508 is cut out of the clasp 506 and shaped to travel in an indicator groove 124. The keyed alignment member 508 is positioned on the clasp 506 so that the clasp 506 can encircle a connector body and the keyed alignment member 508 can engage an indicator groove 124 disposed on the connector. As an example, the indicator groove or grooves may be provided on either the jack-side connector or the plug-side connector.

Figure 11:
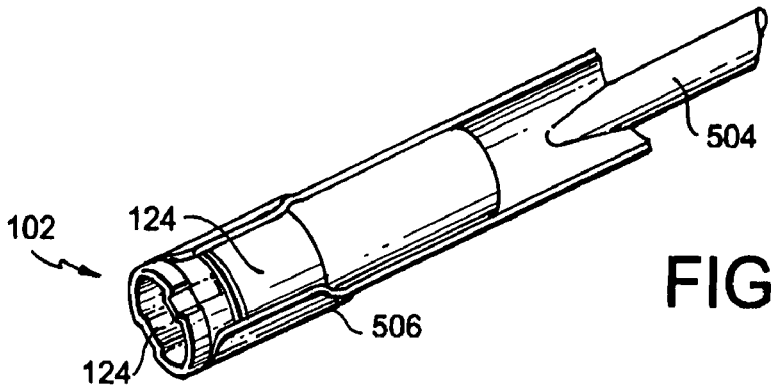
FIG. 11 is a perspective view of the connector and tool coupling showing the indicator groove visible to the operator.
Figure 10:
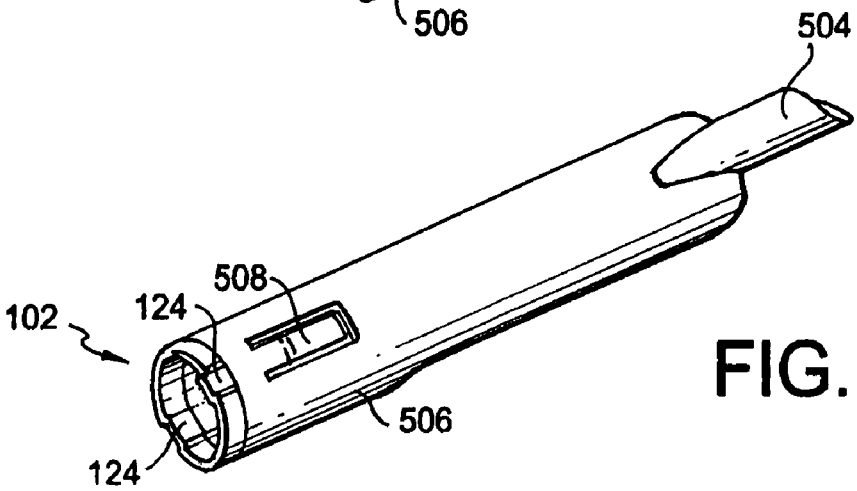
FIG. 10 is a perspective view of the connector and tool coupling showing the keyed alignment member engaged in a groove of a plug-side connector.

Referring to FIGS. 10 and 11, clasp 506 is shown detachably engaged with a plug-side connector 102. As shown in FIG. 10, the keyed alignment member 508 is engaged with the indicator groove 124. As shown on FIG. 11, the clasp 506 may not fully encircle the connector, thereby allowing a visual inspection of at least one indicator groove 124.

In an exemplary embodiment, the installation and removal tool 500 is used to install and remove the plug-side connector 102 with the jack-side connector 104 and the two indicator grooves 124 are placed approximately one hundred eighty degrees apart from one another. The clasp 506 detachably engages the plug-side connector 102 by partially encircling the bayonet sleeve 108. The partial encirclement of clasp 506 allows at least one indicator groove 124 to be visually inspected. The keyed alignment member 508 is disposed on the clasp 506 so that it engages the indicator groove when it is not visible.

To detachably engage the installation and removal tool 500 with the plug-side connector 102, the operator aligns the keyed alignment member 508 with at least one of the indicator groove 124 on the connector. In an exemplary embodiment, the keyed alignment member 508 would be aligned with either one of the two indicator grooves 124 on the bayonet sleeve 108. Next, the operator would slide the installation and removal tool 500 longitudinally over the connector so that the keyed alignment member 508 would travel longitudinally within the indicator groove 124. To disengage the installation and removal tool 500 from an electrical connector, the operator would reverse the steps above.

To connect the installation and removal tool 500 and the plug-side connector 102, the operator aligns the keyed alignment member 508 with the indicator groove 124 on the connector. In an exemplary embodiment, the keyed alignment member 508 aligns with either one of the two indicator grooves 124 on the bayonet sleeve 108. Next, the operator slides the installation and removal tool 500 longitudinally over the connector so that the keyed alignment member 508 would travel longitudinally within the indicator groove 124. Then, the operator mates the connectors by using the installation and removal tool 500. The operator aligns the slots of the first connector with the lugs of the second connector of the coupling connector assembly 100. To complete the coupling, the operator rotates the installation and removal tool 500 so that the slots on the first connector engage corresponding lugs on the second connector.

More specifically, the operator aligns the J-shaped slots 116 in the bayonet sleeve 108 to first receive the lugs 122 in the entry portion 118 of the J-shaped slots 116, such that the coupling connector pair are partially engaged. The operator then applies torque to the handle 502 of the installation and removal tool 500. The torque is then transmitted from the handle 502 through the shaft 504 to the clasp 506 that is encircling bayonet sleeve 108. The torque is transmitted to the bayonet sleeve 108 because the keyed alignment member 508 is engaged to one of the indicator grooves 124 of the bayonet sleeve 108. The bayonet sleeve 108 is then rotated relative to the jack-side connector 106 until the lugs 122 slide into the terminal portion 120 of the J-shaped slots 116. The coupling connector pair 100 is then fully engaged. The lugs 122 are held and locked into the terminal portion 120 of the J-shaped slots 116. The twist-lock connection of the bayonet mechanism is completed and the connectors are fully engaged, thereby preventing connectors from gradually becoming loose or inadvertently unplugged.

To disengage the installation and removal tool 500 from the connector, the operator longitudinally slides away from the connector assembly 100 so that the keyed alignment member 508 longitudinally slides within the indicator groove 124 away from the connector assembly 100.

The tool 500 may also include an additional alignment member, such as a tab 600 to facilitate initial engagement with the connector 102. Specifically, the alignment tab 600 extends from the end of the tool 500, as seen in FIG. 11. The alignment tab 600 engages the groove 124 at the end of the connector 102, as seen in FIG. 12.

While particular embodiments have been chosen to illustrate the exemplary aspects of the present invention, it will be understood by those skilled in the art that various changes and modifications can be made without departing from the scope of the invention as defined in the appended claims.

What is claimed is:

1. An electrical connector, comprising of:
a body; and
a sleeve rotatably coupled to said body and including,
at least one slot having an entry portion and a terminal portion and adapted to engage a portion of at least one other connector, and
at least one indicator groove aligned with said terminal portion of said slot, said indicator groove extending through the entire width of said sleeve from one end of said sleeve to another opposite end of said sleeve,
wherein said indicator groove being configured to align with the portion of the at least one other connector when the portion of the at least one other connector is received in said terminal portion of said slot.

2. The electrical connector according to claim 1, wherein said sleeve has a plurality of slots configured for engagement with corresponding portions of the at least one other connector.

3. The electrical connector according to claim 1, wherein said at least one slot and said at least one indicator groove are formed at an exterior surface of the sleeve.

4. The electrical connector according to claim 1, wherein the portion of the at least one other connector being a lug.

5. The electrical connector according to claim 1, wherein the connector includes a bayonet plug-side connector.

6. The electrical connector according to claim 1, wherein the at least one other connector includes a bayonet jack-side connector.

7. An electrical connector assembly, comprising:
at least one plug-side connector adapted to connect with at least one jack-side connector, said at least one plug-side connector including,
a body having at least one slot,
a bayonet sleeve having at least one indicator groove, said indicator groove extending through the entire width of said sleeve from one end of said sleeve to another opposite end of said sleeve, and
a ferrule; and
said at least one jack-side connector including,
a body, and
at least one lug adapted to engage said slot such that said at least one lug is aligned with said indicator groove.

8. The electrical connector assembly according to claim 7, wherein each at least one jack-side connector further includes at least one of at least one connector insulator and at least one lumen.

9. The electrical connector assembly according to claim 7, wherein the at least one jack-side connector is made at least in part of at least one conductive material.

10. The electrical connector assembly according to claim 7, wherein the at least one lug is cylindrically shaped.

11. The electrical connector assembly according to claim 7, wherein each of the at least one plug-side connectors further includes at least one of at least one means for biasing, and at least one connector insulator.

* * * * *